US008657484B1

(12) United States Patent
Bottiger

(10) Patent No.: US 8,657,484 B1
(45) Date of Patent: Feb. 25, 2014

(54) APPARATUS FOR MIXING CONTENTS ENCLOSED WITHIN A CONTAINER

(75) Inventor: Jerold R. Bottiger, Aberdeen, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 38 days.

(21) Appl. No.: 13/352,733

(22) Filed: Jan. 18, 2012

(51) Int. Cl.
*B01F 13/08* (2006.01)

(52) U.S. Cl.
USPC ..... 366/273

(58) Field of Classification Search
USPC ..... 366/273, 274
See application file for complete search history.

(56) References Cited

U.S. PATENT DOCUMENTS

| | | | | |
|---|---|---|---|---|
| 3,494,597 | A * | 2/1970 | Rosinger | 366/273 |
| 3,693,941 | A * | 9/1972 | Suchy | 366/274 |
| 5,352,036 | A * | 10/1994 | Haber et al. | 366/273 |
| 2008/0013400 | A1 * | 1/2008 | Andrews et al. | 366/274 |

* cited by examiner

*Primary Examiner* — Tony G Soohoo
*Assistant Examiner* — Anshu Bhatia
(74) *Attorney, Agent, or Firm* — Ulysses John Biffoni

(57) ABSTRACT

An apparatus for mixing contents within an enclosed container, which includes a mixing element composed of a magnetically interactive material, which is configured for placement within the enclosed container, a movable member disposed outside of the enclosed container, the movable member being magnetically engageable with the mixing element, a base member for positioning the movable member proximate the enclosed container, and a motor adapted for driving the movable member in a continuous, reciprocating or oscillating motion relative to the enclosed container, wherein the movable member interacts with and urges the mixing element to translate between a first position and a second position within the container, and one of the mixing element or an end portion of the armature is a magnet.

16 Claims, 2 Drawing Sheets

APPARATUS FOR MIXING CONTENTS ENCLOSED WITHIN A CONTAINER

GOVERNMENT INTEREST

The invention described herein may be manufactured, used and licensed by or for the U.S. Government.

FIELD OF THE INVENTION

The present invention relates to mixing devices, and more particularly to apparatus adapted for mixing contents enclosed within a container by magnetic action.

BACKGROUND OF THE INVENTION

Magnetic stirring or mixing devices used for mixing fluids such as slurries, solutions or suspensions are commercially available in the market. Such magnetic stirrers generally employ a magnetic stir bar immersed in a liquid-filled container such as a beaker, and a rotating magnetic field to cause the stir bar to spin rapidly. The resulting spinning action stirs the liquid continuously. A magnetic stirrer typically includes the magnetic stir bar, a flat platform or base supporting thereon the container of liquid, and a rotating magnet assembly or set of stationary magnets disposed within the base to create the rotating magnetic field below the container. The magnetic stir bar is usually a bar magnet coated with a plastic, porcelain, or glass material to make it chemically inert.

Although true solutions do not usually require constant mixing, suspensions containing small particles (e.g., biological cells, micro-solids, protein) must be constantly mixed to prevent the particles from separating out over time due to gravitational settling, especially in enclosed containers. Absent constant mixing, uniformity in the concentration and distribution of the particles diminishes over time. Magnetic stirrers are particularly useful for maintaining uniform mixtures. However, it becomes problematic where the container is positioned or mounted on devices such as in a syringe pump assembly in a manner that access to the container by conventional magnetic stirrers is unavailable.

Accordingly, there is a need in the art to develop an apparatus for mixing contents enclosed within a container with enhanced flexibility and efficiency. There is a further need for such an apparatus that can be implemented for use with enclosed containers arranged in various embodiments and configurations including elongated containers such as syringes.

SUMMARY OF THE INVENTION

The present invention relates generally to an apparatus for mixing contents enclosed within a container such as a syringe by magnetic action. The apparatus of the present invention is designed with enhanced flexibility and portability useful for accommodating different container configurations and placements thereof. In particular, the apparatus of the present invention is especially useful where the container is positioned or mounted on devices such as in a syringe pump assembly, and access to the container by the conventional magnetic stirrer is problematic.

The apparatus of the present invention includes a continuous, oscillating or reciprocating member, which can be selectively positioned proximate an accessible portion of a container, and a mixing element freely movable within the container and magnetically engageable with the continuous, oscillating or reciprocating member. During operation, the continuous, oscillating or reciprocating member moves in a manner causing the mixing element to shift or translate between a first position and a second position within the container. The apparatus of the present invention is relatively simple and cost effective to make and implement.

In one aspect of the present invention, there is provided an apparatus for mixing contents within an enclosed container, which comprises:

a mixing element configured for placement within the enclosed container;

a movable member disposed outside of the enclosed container, the movable member being magnetically engageable with the mixing element;

a base member for positioning the movable member proximate the enclosed container; and a motor adapted for driving the movable member in a continuous, reciprocating or oscillating motion relative to the enclosed container, wherein the movable member interacts with and urges the mixing element to translate between a first position and a second position within the container.

BRIEF DESCRIPTION OF THE DRAWINGS

The following drawings are illustrative of embodiments of the invention and are not intended to limit the invention as encompassed by the claims forming part of the invention.

DETAILED DESCRIPTION OF THE INVENTION

The present invention is directed to an apparatus for mixing contents enclosed within a container such as a syringe by magnetic action. The apparatus of the present invention is designed with enhanced flexibility and portability useful for accommodating different container configurations and placements thereof. In particular, the apparatus of the present invention is especially useful where the container is positioned or mounted on devices such as in a syringe pump assembly, and access to the container by the conventional magnetic stirrer is problematic.

The apparatus of the present invention includes a continuous, oscillating or reciprocating member, which can be selectively positioned proximate an accessible portion of a container, and a mixing element freely movable within the container and magnetically engageable with the continuous, oscillating or reciprocating member. During operation, the continuous, oscillating or reciprocating member moves in a manner causing the mixing element to shift or translate between a first position and a second position within the container. The apparatus of the present invention is relatively simple and cost effective to make and implement.

There is provided an apparatus for mixing contents within an enclosed container, which includes a mixing element configured for placement within the enclosed container, a movable member disposed outside of the enclosed container, where the movable member is magnetically engageable with the mixing element, a base member for positioning the movable member proximate the enclosed container, and a motor adapted for driving the movable member in a continuous, reciprocating or oscillating motion relative to the enclosed container, wherein the movable member interacts with and urges the mixing element to translate between a first position and a second position within the container.

Figure 1:
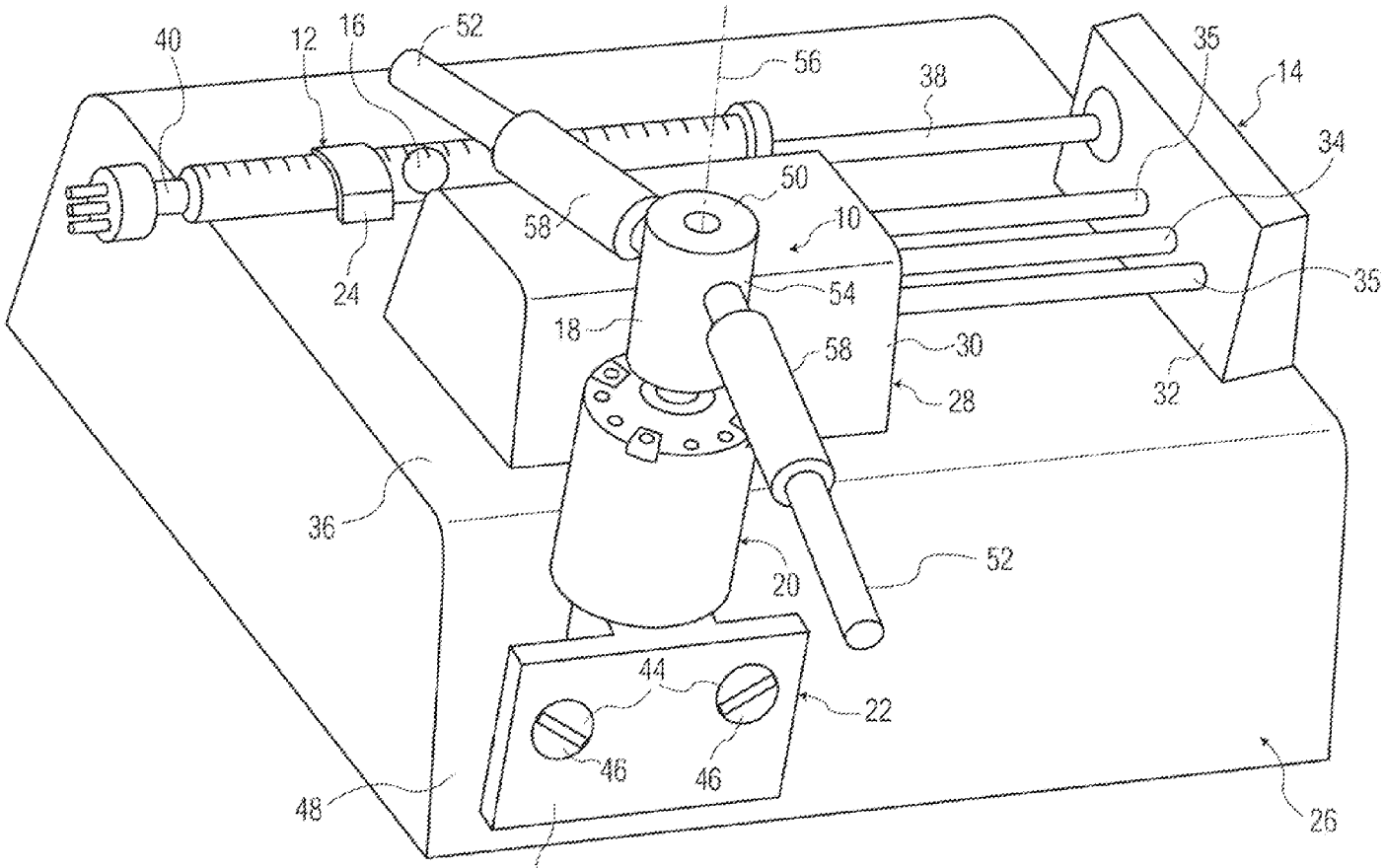
FIG. 1 is a perspective view of an apparatus for mixing contents within an enclosed container mounted to a syringe pump assembly for one embodiment of the present invention.

In reference to FIG. 1, there is shown an apparatus, identified generally by reference numeral 10, useful for magnetically mixing contents enclosed within a container in accordance with one embodiment of the present invention. As noted above, the apparatus 10 is especially useful where the container is positioned or mounted on devices such as, for example, a syringe pump assembly, and access to the container by the conventional magnetic stirrer is problematic. Although the apparatus 10 will be described in context of its usage with a container in the form of a syringe mounted on a syringe driver or pump assembly, it will be understood that the present invention can be used with any container, which may or may not be mounted on a device, and that its use with the syringe pump assembly is made specifically for purposes of illustrating the operation of the apparatus 10, and not intended to limit the scope of the present invention.

As shown in FIG. 1, the apparatus 10 is implemented to mix the contents of the syringe 12 supported on the syringe pump assembly 14. The apparatus 10 includes a mixing element 16 disposed within the syringe 12, a rotatably movable member 18 magnetically engageable with the mixing element 16, a motor 20 axially coupled to the movable member 18, and a base member 22 attached to the motor 20 at an opposite end from the movable member 18. The motor 20 is powered by a voltage source (not shown) via a switch (not shown).

The mixing element 16 of the apparatus 10 is able to move freely from one end of the syringe 12 to the other to effectively agitate the fluid content retained in the syringe 12. In a preferred embodiment of the present invention, the mixing element 16 is ball-shaped with a diameter preferably about half the inner diameter of the syringe 12. The mixing element 16 includes optionally a protective or chemically inert coating selected, for example, from nickel, gold, polytetrafluoroethylene (PTFE), and combinations thereof. As will be understood, the present invention facilitates mixing of the contents within the container with little or no interference with the operation of the container and the device to which the container is affixed.

In a further preferred embodiment of the present invention, the movable member 18 and the mixing element 16 is composed of a magnetically interactive material. The term "magnetically interactive material" is intended to refer to any material exhibits attraction to a magnet or one that can be magnetized to generate a persistent magnetic field. The magnetically interactive material can be selected from a ferromagnetic material such as, for example, iron, nickel, cobalt, rare earth metals, and combinations thereof. Preferably, the magnetically interactive material is a neodymium-based material. It is noted that in the present invention at least one of the mixing element 16 and the movable member 18 is magnetized (e.g., permanent magnet) for inducing magnetic engagement therebetween.

The syringe 12 with a plunger 38 and a nozzle 40 is affixed in position to the syringe pump assembly 14 via a syringe barrel clamp 24. The syringe pump assembly 14 includes a support base 26, and a pusher mechanism 28 disposed on a top portion 36 of the support base 26. The pusher mechanism 28 includes a motor 30 for driving a movable pusher 32 via screw rod 34. The movable pusher 32 rides on a pair of guide rails 35. The pusher 32 is affixed to the syringe plunger 38 for actuating infusion or withdrawal of a volume fluid through the syringe nozzle 40.

The base member 22 disposed at the lower portion of the motor 20 comprises a mounting plate 42 with a pair of fastener holes 44 each for receiving a fastener 46. The mounting plate 42 is adapted to affix the apparatus 10 to a side portion 48 of the support base 26 via the fasteners 46, and securely position the movable member 18 proximate the syringe 12. The motor 20 is configured to rotate the movable member 18 at the upper portion thereof. It is noted that the base member 22 is not limited to the form of a mounting plate, and that it is contemplated that the base member can encompass any fixed or adjustable device or mechanism such as, a clamp, a strap, a stand, a rod clamp, suitable for selectively positioning or fastening the movable member at a location proximate an accessible portion of a container.

The movable member 18 includes an armature 50 with a pair of opposed elongate arms 52 extending from a center coupling portion 54 thereof. A flexible joint 58 located at a point along the length of the respective arm 52 allows the arm 52 to be suspended slightly downward. The center coupling portion 54 and the arms 52 driven by the motor 20 are adapted to rotate about a central axis 56. The distal ends of the arms 52 are composed of a magnetically interactive material, and configured to magnetically engage the mixing element 16 disposed within the syringe 12.

During operation, the syringe 12 is positioned at an incline relative to the horizontal plane so that the plunger 38 is elevated. This can be achieved by tilting the syringe pump assembly 14. With the syringe 12 positioned at an angle, the mixing element 16 moves under gravity to a neutral resting position proximate the syringe nozzle 40. Each of the rotating arms 52, moving in succession over the length of the syringe 12 from the nozzle 40 to the plunger 38, magnetically engages the mixing element 16 and pulls it up through the fluid contents to the opposite elevated end of the syringe 12 with each pass, thus agitating the fluid contents in the process. At the end of each pass, the mixing element 16 drops back down to its neutral resting position at the lower or non-elevated end of the syringe 12 proximate the nozzle 40, at which point it is picked up again for a next pass by the opposite rotating arm 52. The mixing element 16 completes two cycles of travel for every revolution of the armature 50.

Figure 2:
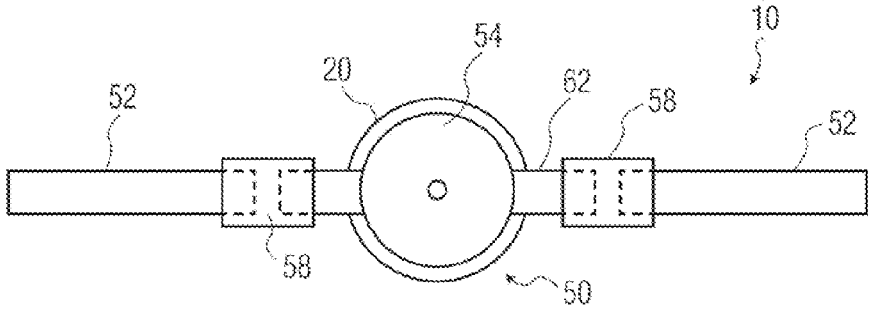
FIG. 2 is an elevational view of the apparatus of FIG. 1 in accordance with an embodiment of the present invention.
Figure 3:
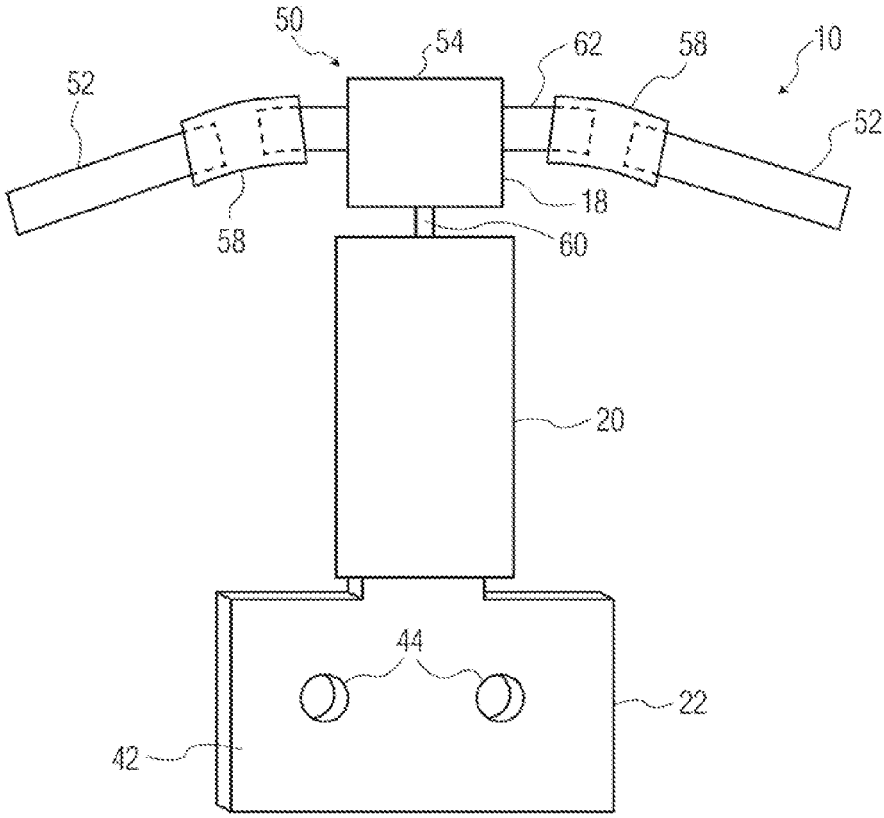
FIG. 3 is a top plan view of the apparatus in accordance with an embodiment of the present invention.

In reference to FIGS. 2 and 3, the mounting plate 42 of the base member 22 is rigidly attached to the base of the motor 20 via suitable means such as, for example, welding. The motor 20 includes a drive shaft 60 attached to the center coupling portion 54 of the armature 50. A cross beam 62 is disposed through the center coupling portion 54 which is attached to the arms 52 at the respective ends thereof via the flexible joints 58. The flexible joints 58 are composed of a resilient or elastomeric tubular material such as, for example, polyvinyl chloride (PVC), polyurethane, low density polyethylene, rubber, latex, silicone, and the like.

The arms 52 are preferably selected from a cylindrical, elongated magnetically interactive material. The length of the arms 52 are selected for sufficient reach to the non-elevated lower portion of the container or syringe 12. The motor 20 of the apparatus 10 is preferably selected from a high-speed direct current motor utilizing a high ratio gear arrangement (not shown) to provide reduced rotation speed and enhanced torque.

Alternatively, where the syringe 12 is positioned flat or parallel with the ground, the motor 20 can be set to drive the armature 50 in an oscillating manner. In this mode, the arm 52 is moved backward and forward over the length of the syringe 12. Thus, the mixing element 16 is magnetically pulled through the syringe 12 to one end and back to the other end repeatedly to ensure continuous mixing. The oscillating operation of the motor 20 can be implemented by reversing the polarity of the voltage applied in a periodic manner. This polarity change can be effected through the use of microswitches (not shown) in operative engagement with the armature 50 or through the use of a simple timing device (not shown) that reverses the polarity every selected point in the cycle (e.g., half-revolution). Although rotation speed is a secondary consideration, a potentiometer (not shown) can be used to adjust the voltage levels to the motor 20, thereby controlling the speed of the armature 50.

The forgoing discussion discloses and describes merely exemplary embodiments of the present invention. One skilled in the art will readily recognize from such discussion, and from the accompanying claims, that various changes, modifications, and variations can be made therein without departing from the spirit and scope of the invention as defined in the following claims.

What is claimed is:

1. An apparatus for mixing contents within an enclosed container, said apparatus comprising:

a mixing element configured for placement within the enclosed container;

a moving member disposed outside of the enclosed container, said movable member being magnetically engageable with the mixing element; wherein the movable member comprises an armature attached to a motor, wherein the armature includes at least two arms spaced apart radially from one another and wherein said motor is adapted for driving the arms in a continuous, reciprocating or oscillating motion relative to the enclosed container, wherein the arms magnetically interact with and urge the mixing element to translate between a first position and a second position within the container; wherein each of said arms includes a flexible joint disposed at a point along the length thereof and a base member for positioning the movable member proximate the enclosed container.

2. The apparatus of claim 1, wherein the base member is adapted for attachment to a portion of a workpiece.

3. The apparatus of claim 2, wherein the base member comprises:

a mounting plate; and at least one aperture disposed in the mounting plate for receiving a fastener therethrough.

4. The apparatus of claim 1, wherein the mixing element is spherical.

5. The apparatus of claim 1, wherein the mixing element and the movable member, each comprises a magnetically interactive material.

6. The apparatus of claim 5, wherein at least one of said mixing element or a free end of said arms of said movable member is as magnetized form of the magnetically interactive material.

7. The apparatus of claim 5, wherein the magnetically interactive material is a ferromagnetic material.

8. The apparatus of claim 7, wherein the ferromagnetic material is selected from a group consisting of iron, nickel, cobalt, rare earth metals, and combinations thereof.

9. The apparatus of claim 8, wherein the ferromagnetic material is neodymium.

10. The apparatus of claim 5, wherein the mixing element includes a protective coating.

11. The apparatus of claim 10, wherein the protective coating is selected from the group consisting of nickel, gold, polytetrafluoroethylene, and combinations thereof.

12. The apparatus of claim 1, wherein:

each of said at least two arms includes:

a first elongated segment having one end rigidly secured to a driveshaft of said motor and a free end; and a second elongated segment; and the flexible joints of each of said arms each include a resilient tubing having opposed openings for receiving the free end of the first elongated segment, and an end of said second elongated segment, for allowing said second segment to be suspended downward relative to said base member.

13. The apparatus of claim 12, wherein the mixing member and the second elongated segment, each comprises a magnetically interactive material.

14. The apparatus of claim 13, wherein at least one of said mixing element and the segment of each of said at least two arms is a magnetized form of the magnetically interactive material.

15. The apparatus of claim 1, wherein said container comprises a syringe.

16. The apparatus of claim 15, wherein said syringe is positioned at an incline relative to the horizontal plane so that a first end of said syringe is elevated and the mixing element moves under gravity to a neutral resting position proximate a second end of said syringe.

* * * * *